United States Patent [19]

Katoh et al.

[11] 3,975,798

[45] Aug. 24, 1976

[54] SAFETY DEVICE OF A CARDING MACHINE PROVIDED WITH A PAIR OF CRUSHING ROLLERS

[75] Inventors: Takashi Katoh, Kariya; Hideo Hidaka, Aichi; Singo Oda, Nagoya, all of Japan

[73] Assignee: Kabushiki Kaisha Toyoda Jidoshokki Seisakusho, Japan

[22] Filed: Dec. 18, 1974

[21] Appl. No.: 533,950

[52] U.S. Cl. ..... 19/98; 241/167

[51] Int. Cl.[2] ..... D01G 15/96

[58] Field of Search ..... 241/167, 232; 15/256.51; 19/98, 106 R, 272

[56] References Cited

UNITED STATES PATENTS

| | | | |
|---|---|---|---|
| 2,075,156 | 3/1937 | Albero | 241/167 |
| 2,979,783 | 4/1961 | Whitehurst | 15/256.51 |
| 2,997,748 | 8/1961 | Ingram | 19/98 |
| 3,259,945 | 7/1966 | Zoch | 19/106 R |
| 3,327,341 | 6/1967 | Kuehn | 15/256.51 |
| 3,364,527 | 1/1968 | Ramo | 19/106 R |
| 3,757,381 | 9/1973 | Sanders | 15/256.51 |

*Primary Examiner*—Granville Y. Custer, Jr.
*Attorney, Agent, or Firm*—Burgess Ryan and Wayne

[57] ABSTRACT

Safety device of a carding machine provided with a pair of crushing rollers wherein a scraping plate is urged to the cylindrical surface of each crushing roller for the entire length thereof. Each scraping plate is turnably supported by a pin so that it can be moved away from the corresponding crushing roller when required. The turning motion of each scraping plate away from or toward the corresponding crushing roller, can be carried out simultaneously by means for setting the position of each scraping plate and a manually operable handle which actuates the setting means. The main driving motor of the carding machine is connected, in series with a main switch and a control switch, to an electric source. The control switch is closed when the handle is operated so as to fix the scraping plates in contacting condition with the corresponding crushing rollers and, on the other hand, the control switch is opened when the scraping plates are moved away from the corresponding crushing rollers.

6 Claims, 7 Drawing Figures

SAFETY DEVICE OF A CARDING MACHINE PROVIDED WITH A PAIR OF CRUSHING ROLLERS

SUMMARY OF THE INVENTION

The present invention relates to a safety-device of a carding machine provided with crushing rollers.

In the cotton spinning industry, it is well known that trash and dust contained in a web of cotton fibers doffed from a doffer of a carding machine can be effectively separated therefrom by passing the web through a pair of crushing rollers disposed between a coiler motion mechanism and a mechanism for doffing the above-mentioned web of cotton fibers from the doffer. That is, the trash and dust contained in the web are crushed by the strong nip action of the crushing rollers when they pass through the nip line of the rotating crushing rollers and are dropped from the web during transportation of the web. However, according to our experience in mill operation, some of the crushed trash and dust adheres to the cylindrical surface of each crushing roller and, if not removed, causes the fiber web to tend to wrap itself around the cylindrical surface of one or both of the crushing rollers so that the operation of the carding machine has to be stopped.

To prevent the above-mentioned possible trouble, a scraping plate has been utilized. That is, each crushing roller is provided with a scraping plate disposed along the axial direction thereof in such a way that a longitudinal edge of the scraping plate is always urged to the cylindrical surface of the crushing roller. Consequently, even if some crushed trash and dust adheres to the cylindrical surfaces of each of the crushing rollers, such crushed trash and dust is removed from the crushing rollers by the scraping action of the scraping plates. The above-mentioned longitudinal edges of the scraping plates are urged to the corresponding crushing rollers by a resilient urging means and the setting of the resilient urging means is operated manually. The above-mentioned setting operation of the resilient urging means is carried out at predetermined occasions such as after periodic maintenance or cleaning of the carding machine. Consequently, if the above-mentioned setting operation of the resilient urging means is forgotten, there is a strong possibility of the web wrapping itself about either one or both of the crushing rollers. And if the web does become wrapped around either one or both of the crushing rollers a very troublesome and time consuming operation must be carried out to separate the wrapped fibers from the crushing roller.

It is also our experience that, in most cases, since the conventional resilient urging means is disposed below the passage of the web, it is impossible to prevent the deposition of trash and dust, and flies of cotton fibers upon the resilient urging means. And if crushed trash and dust are deposited on such resilient urging means, effective functioning of the scraping plates on the corresponding crushing rollers is spoiled so that the above-mentioned possible wrapping cotton fiber web on either one or both of the crushing rollers can not be completely prevented.

Accordingly, the principal object of the present invention is to provide a safety-device of a carding machine provided with a pair of crushing rollers so as to perfectly eliminate the above-mentioned trouble due to the manual operation of the scraping plates.

According to the present invention, the safety device comprises a pair of scraping plates, each of which is capable of contacting the cylindrical surface of a corresponding crushing roller, means for setting the positions of these scraping plates in a contacting condition with the corresponding crushing rollers or a condition free from the corresponding crushing rollers alternatively, a manually operable handle for actuating the setting means, an electrical means for preventing actuation of a main driving motor of the carding machine when the scraping plates are set in a condition free from the corresponding crushing rollers. Consequently, the carding machine can not be driven in such a condition that the scraping plates are positioned in the condition in which they are spaced from the corresponding crushing rollers, so that the above-mentioned trouble caused by the wrapping of the web about the crushing rollers can be completely prevented.

DETAILED EXPLANATION OF THE PRESENT INVENTION

Figure 1:
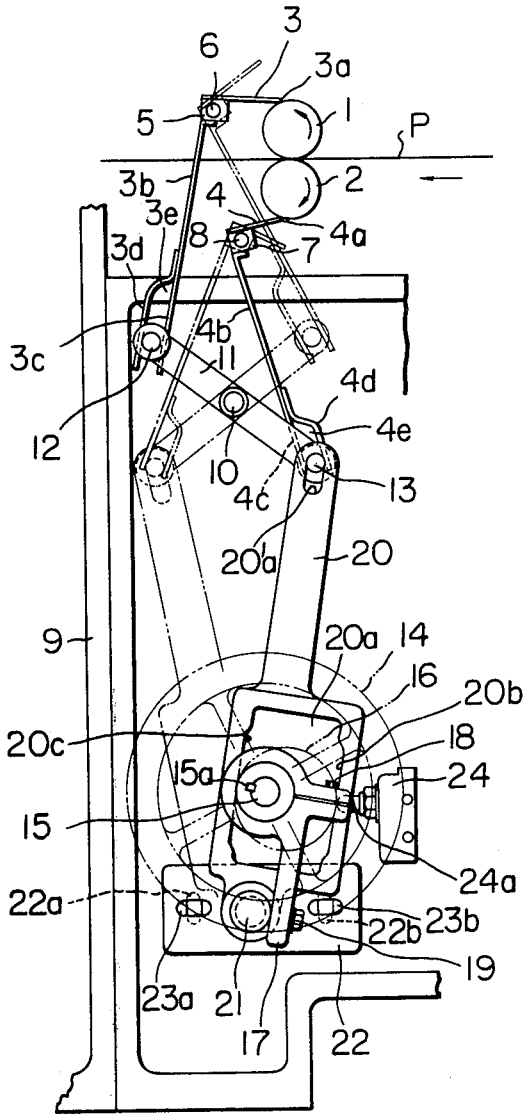
FIG. 1 is a schematic front view of the safety device of a carding machine provided with a pair of crushing rollers according to the present invention.
Figure 2:
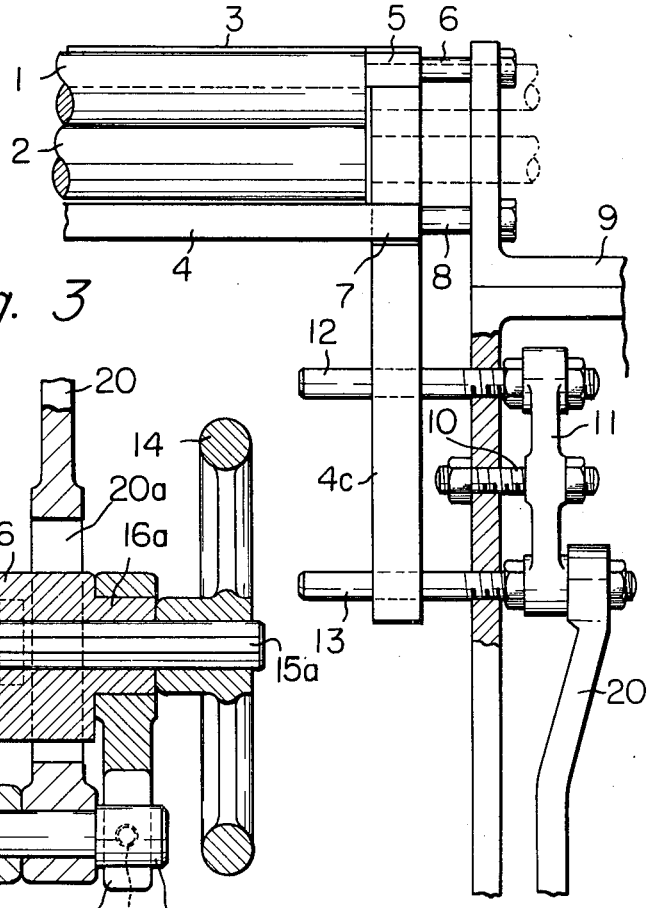
FIG. 2 is a side view of a part of the safety device shown in FIG. 1.
Figure 3:
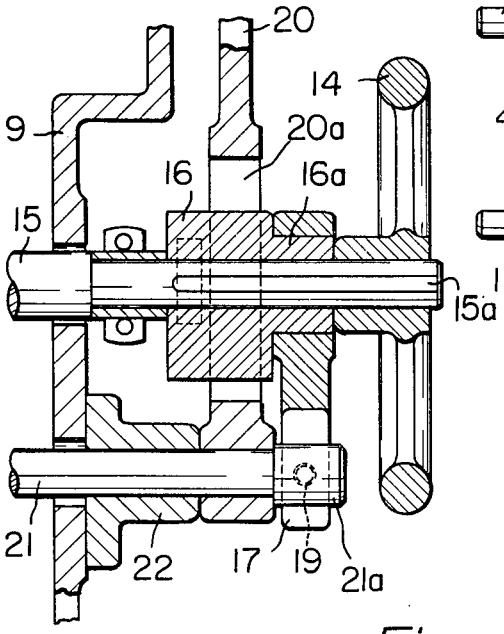
FIG. 3 is a side view of a setting mechanism of the safety device shown in FIG. 1.

Referring to FIGS. 1, 2 and 3, a pair of crushing rollers 1 and 2 are disposed on a carrying passage P of fiber web between a doffing mechanism (not shown) and a coiler motion mechanism (not shown) of a carding machine in a such a condition that the crushing roller 1 is urged to the crushing roller 2 in rotating condition. In such condition, a top scraping plate 3 is urged to the crushing roller 1 in such a condition that the front edge 3*a* thereof tangentially contacts the cylindrical surface of the crushing roller 1, while a bottom scraping plate 4 is urged to the crushing roller 2 in such a condition that the front edge 4*a* thereof tangentially contacts the cylindrical surface of the crushing roller 2, during the carding operation. Consequently, any crushed trash and dust adhered to the cylindrical surfaces of the crushing rollers 1, 2 can be effectively removed from the crushing rollers 1 and 2. The scraping plates 3 and 4 extend parallel to the horizontal axis of the crushing rollers 1 and 2 for the entire length thereof. The scraping plate 3 is secured to a pair of brackets 5 at both sides thereof, while the scraping plate 4 is secured to a pair of brackets 7 at both sides thereof as shown (one side only) in FIG. 1. The brackets 5 and 7 are turnably mounted on horizontal pins 6 and 8 mounted on a machine frame 9 (FIG. 2).

Since the safety device of this embodiment has a pair of substantially identical mechanisms disposed at both sides of the carding machine, only the mechanism of the safety device of one side is hereinafter explained in detail. A plate spring 3*b* is secured to one of the brackets 5, while a plate spring 4*b* is secured to the bracket 7 which faces the bracket 5 provided with the plate spring 3*b*. At a free end portion 3*c* of the plate spring 3*b*, there is provided a branch plate 3*d* so that a guide space 3*e* is formed between the free end portion 3*c* of the plate spring 3*b* and the branch plate 3*d*.

A branch plate 4*d* is secured to a free end portion 4*c* of the plate spring 4*b* so as to form a guide space 4*c* between the free end portion 4*c* and the branch plate 4*d* as shown in FIG. 1.

A horizontal supporting pin 10 is mounted on the machine frame 9 at a position below the pin 8, and a connecting arm 11 is turnably mounted on the supporting pin 10 at the outside of the machine frame 9. At an end portion of the arm 11, there is provided a horizontal guide pin 12 in such a condition that the guide pin 12 is always capable of sliding along the guide space 3*e*, while a horizontal pivot pin 13 is rigidly held by the other end portion of the arm 11 in such a condition that the pivot pin 13 is always capable of sliding along the guide space 4*e*.

A manually operation handle 14 is mounted on an end portion of a cross-shaft 15 and secured thereto by a Key 15*a*. An eccentric cam 16 is also secured on the cross-shaft 15 by the Key 15*a*. In this embodiment, the eccentric cam 16 is provided with a cylindrical cam surface. A stop lever 17 is rigidly mounted on an extended portion 16*a* (FIG. 3) of the eccentric cam 16, and the relative angular setting position of the stop lever 17 on the extended portion 16*a* of the eccentric cam 16 can be adjustably fixed by a fastening bolt 18. At a free end portion of the stop lever 17, there is provided an adjusting bolt 19 by way of screw engagement. A holding pin 21 is horizontally secured to a bracket 22 moounted on the machine frame 9, and a swing lever 20 is turnably mounted on the holding pin 21 as shown in FIGS. 1 and 3. The guide pin 13 is engaged in a cut-out space 20'*a* formed at a free end portion of the swing lever 20.

Consequently, the turning motion of the arm 11 about the supporting pin 10 from a position represented by a solid line to a position represented by a dot-dash line in FIG. 1 can be easily induced by the turning motion of the swing lever 20 from a position represented by a solid line to a dot-dash line in FIG. 1. According to the above-mentioned turning motion of the swing lever 20, the scraping plates 3 and 4 can be moved away from the cylindrical surfaces of the crushing rollers 1 and 2, respectively, as shown in FIG. 1. As already explained, the swing lever 20 is provided with the cut-out space 20*a*, and the eccentric cam 16 engages into the space 20*a* of the swing lever 20 in such a condition that a front surface 20*b* and a rear surface 20*c* of the space 20*a* slidably contacts the cylindrical surface of the eccentric cam 16. The holding pin 21 is provided with a radially expanded portion 21*a* and the adjusting bolt 19 is capable of contacting the radially expanded portion 21*a* of the holding pin 21. The bracket 22 is provided with a pair of slots 22*a* and 22*b*, while a pair of slots 23*a* and 23*b* are formed in the machine frame 9. The bracket 22 is adjustably secured to the machine frame 9 by a pair of fastening bolts and nuts (not shown) which pass through a pair of the combination of the slots 22*a* and 23*a*, 22*b* and 23*b*, respectively. That is, the relative position of the bracket 22 to the machine frame 9 can be changed, so as to adjust the distance between the holding pin 21 and the cross-shaft 15. According to the above-mentioned adjustment of the distance between the holding pin 21 and the cross-shaft 15, the urging force of the scraping plates 3 and 4 against the corresponding crushing rollers 1 and 2 can be easily changed.

A limit switch 24 is rigidly mounted on the machine frame 9 in such a condition that an actuator 24*a* mounted on the stop lever 17 is capable of contacting a feeler (not shown) of the limit switch 24 when the scraping plates 3 and 4 are positioned at their contacting position with the respective crushing rollers 1 and 2.

In the above-mentioned mechanism, the handle 14, the stop lever 17 and the limit switch 24 are disposed outside the same side of the machine frame 9. The condition of the eccentric cam 16 shown in FIG. 1 represents the above-mentioned contacting condition of the scraping plates 3 and 4, respectively, wherein the radially expanded portion 21*a* of the holding pin 21 contacts the adjusting bolt 19. Therefore, when it is required to position the scraping plates 3 and 4 so that they are in contact with the crushing rollers 1 and 2, respectively, the handle 14 is turned clockwise until the adjusting bolt 19 contacts the radially expanded portion 21*a* of the holding pin 21 and the turning motion of the handle 14 is stopped when the adjusting bolt 19 contacts the expanded portion 21*a* of the holding pin 21. In this condition, the limit switch 24 is actuated.

It is essential to maintain the above-mentioned working condition of scraping plates 3 and 4, swing lever 20, eccentric cam 16 and stop lever 17 during the operation of the carding machine. To stably attain such working condition, it is essential to stop the turning motion of the handle 14 when a dead point of the eccentric cam 16, which corresponds to a maximum radial position of the cylindrical surface thereof from an axial center thereof, slightly passes a contact point with the front surface 20*b* of the cut-out space 20*a* of the swing lever 20. In this condition, the swing lever 20 can be stably stopped because of a resilient force created by the plate springs 3*b* and 4*b*. Consequently, the relative angular position about the cross-shaft 15 between the eccentric cam 16 and the stop lever 17 is fixed in the following manner. Before fixing the relative angular position about the cross-shaft 15 between the eccentric cam 16 and the stop lever 17, the fastening bolt 18 is loosened. Next, the handle 14 and the eccentric cam 16 are turned counter-clockwise for about 180° from the condition shown in FIG. 1. Thereafter, the handle 14 is turned clockwise (in FIG. 1) until the above-mentioned dead point of the eccentric cam 16 slightly passes over the contacting point with the front surface 20*b* of the cut-out space 20*a* of the swing lever 20. In this condition, the stop lever 17 is turned clockwise (in FIG. 1) until the adjusting bolt 19 contacts the radially expanded portion 21*a* of the holding pin 21 and, then, the fastening bolt 18 is fastened so as to rigidly secure the stop lever 17 on the extended portion 16*a* of the eccentric cam 16.

When it is required to move the scraping plates 3 and 4 away from the respective crushing rollers 1 and 2 after the normal operation of the crushing rollers 1 and 2, such requirement can be attained by turning the handle 14 counter-clockwise (in FIG. 1). That is, when the handle 14 is turned counter-clockwise, the actuater 24*a* moves away from the feeler of the limit switch 24, the urging of the scraping plates 3 and 4 to the respective crushing rollers 1 and 2 by the plate springs 3*b* and 4*b*, respectively, is gradually decreased, according to the counter-clockwise turning motion of the swing lever 20 and the clockwise turning motion of the arm 11; and, finally the scraping plates 3 and 4 are moved away from the respective crushing rollers 1 and 2. This condition is represented by the dot-dash lines in FIG. 1. During the above-mentioned turning motions of the swing lever 20 and the arm 11, the pins 12 and 13 slide in respective guide spaces 3*e* and 4*e* and, consequently, the turning motion of the swing lever 20 can be smoothly transmitted to the turning motions of the plate springs 3*b* and 4*b* about the respective pins 6 and 8.

Figure 4:
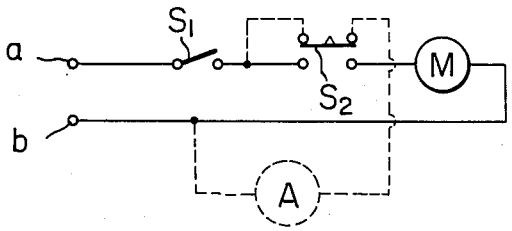
FIG. 4 is a diagram of an electric circuit utilized for the carding machine provided with the safety device shown in FIG. 1.

To prevent the operation of the carding machine in a condition wherein the scraping plates 3 and 4 are not operating upon, i.e. urged against, the respective crushing rollers 1 and 2, a particular electric circuit connecting an electric source and a main motor M of the carding machine is provided in the present invention. Referring to FIG. 4, in an electric circuit connecting the electric source with the main motor M of the carding machine utilized for the present invention, a main switch $S_1$, and a control switch $S_2$ of the limit switch 24 are inserted in series between one terminal *a* of the electric source and the main motor M, and the other terminal *b* of the electric source is connected directly to the main motor M. The carding machine can not drive without the limit switch 24 being closed, and the limit switch 24 is closed when the eccentric cam 16 actuates the actuator 24*a* of the limit switch 24. In other words, if the scraping plates 3 and 4 are positioned away from the corresponding crushing rollers 1 and 2, the carding machine can not operate even though the main switch $S_1$ is closed.

In the above-mentioned embodiment, a so-called push-button switch provided with a magnetic relay can be utilized instead of the above-mentioned main switch $S_1$, and in such condition, the switch $S_2$ of the limit switch 24 is connected in series with an operation coil of the above-mentioned magnetic relay so as to attain the same result as the above-mentioned embodiment. Further, a so-called non-contact type limit switch can be utilized instead of the above-mentioned contact type limit switch 24. It is also useful to adopt an alarm system beside the above-mentioned particular electric circuit. For example, an alarm A is additionally utilized in the electric circuit represented by a solid line in FIG. 4. In this example, one terminal of the alarm A is connected to a terminal *b* of the electric source, while the other terminal of the alarm A is connected to a line between the main switch $S_1$ and the closed contact of the switch $S_2$ of the limit switch 24 as shown by a broken line in FIG. 4. Consequently, if the main switch $S_1$ is closed without closing the line between the main switch $S_1$ and the motor M, the alarm A is actuated to all the operator's attention to the condition.

As already explained, the mechanism for setting the positions of the scraping plates is disposed outside the machine frame and, therefore, serious dust or fly deposition on this mechanism can be effectively prevented so that the function of this mechanism can be effectively maintained.

Figure 5A:
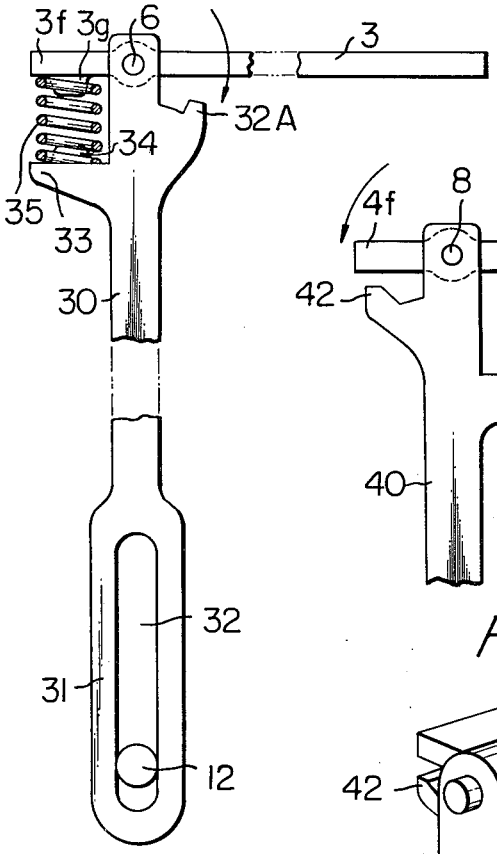
FIGS. 5A and 5B are side views of parts of a modified safety device according to the present invention.
Figure 5B:
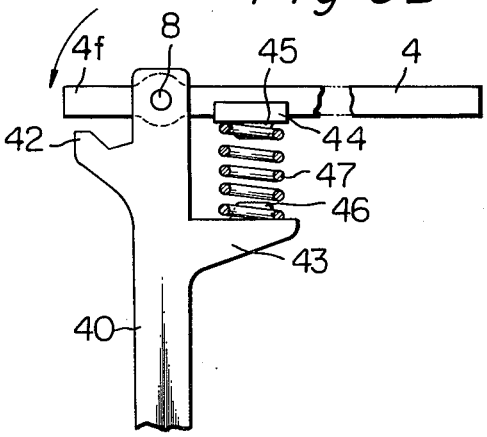
Figure 5C:
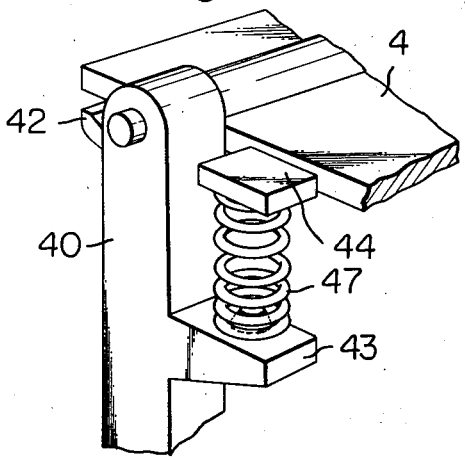
FIG. 5C is a perspective view of a part of the modified safety device shown in FIG. 5B.

In the above-mentioned embodiment, a spring plate 3*b* or 4*b* is utilized for creating a force for urging the scraping plate 3 or 4 toward the corresponding crushing roller 1 and 2, and for maintaining the relative working position of the swing lever 20 to the eccentric cam 16. Instead of utilizing such a pair of spring plates 3*b* or 4*b*, a modification of resilient members shown in FIGS. 5A and 5B can be utilized. In this modification, instead of two spring plates 3*b* and 4*b*, two solid lever 30 are utilized for turnably supporting the scraping plate 3. Each solid lever 30 is provided with the horizontal pin 6 for turnably supporting the scraping plate 3, a slot 32 formed at a bottom portion thereof which permits slidable engagement of the pin 12, a laterally projected step 33 which supports a bottom end of a helical expansion spring 35 and a stopper 32A which restricts the clockwise turning motion of the scraping plate 3 towards the crushing roller 1 when the scraping plate 3 is moved away from the roller 1. The scraping plate 3 is provided with an extended portion 3*f* on the opposite side of the pin 6 from the scraping plate 3 in such a condition that the upper end of the spring 35 always urges the extended portion 3*f* upward in FIG. 5A. A pair of small projections 3*g* and 34 project from the extended portion 3*f* and the step 33 in such conditions that they hold the end portions of the spring 35, respectively. Therefore, the scraping plate 3 is always urged to turn clockwise toward the crushing roller 1, and when the solid lever 30 is turned to a position represented by a solid line of the spring plate 3*b* in FIG. 1, the front edge of the scraping plate 3 is urged to the crylindrical surface of the crushing roller 1 by the expansion force of the spring 35. Further, instead of the two spring plates 4*b*, two solid levers 40 are utilized for supporting the scraping plate 4. Each solid lever 40 is provided with a slot (not shown) like the slot 32 of the solid lever 30 for permitting slidable engagement of the pin 13 therein, a step 43 for receiving a bottom end of helical expansion spring 47 and a stopper 42 which restricts the counter-clockwise turning motion of the scraping plate 4 when the scraping plate 4 is moved away from the crushing roller 2 (FIGS. 1 and 5B). The scraping plate 4 is turnably mounted on the pin 8 secured to the solid lever 40. The scraping plate 4 is also provided with a side projection 44 at a position where a top end of the expansion spring 47 is received as shown in FIGS. 5B and 5C. A pair of projections 45 and 46 project from the side projection 44 and the step 43, respectively, so as to stably position the spring 47. When the solid lever 40 is turned to the position represented by the solid line 4*b* in FIG. 1, the front edge of the scraping plate 4 is urged to the crushing roller 2 due to the expansion force of the spring 47. In the above-mentioned embodiment, the turning motion of each solid lever 30 or 40 is carried out in a manner similar to the first embodiment shown in FIGS. 1, 2 and 3.

As already explained, the safety device according to the present invention is very useful for operating the carding machine provided with crushing roller means and scraping plates.

We claim:

1. Safety device of a carding machine provided with a pair of crushing rollers wherein a scraping plate is urged to a cylindrical surface of each crushing roller for the entire length thereof and a main motor is provided for driving said carding machine together with said crusing rollers; comprising thereabout, means for urging each of said scraping plates to the cylindrical surface of the corresponding crushing roller, means for simultaneously positioning said scraping plates in contact with said crushing rollers or in a position spaced from said crushing rollers alternatively, means for actuating said setting means, an electric switch to open a circuit between said main driving motor and an electric source when said setting means positions each scraping plate to said spaced position from the corresponding crushing roller, respectively or to close the circuit when said setting means positions each scraping plate in contact with the corresponding crushing roller.

2. Safety device of a carding machine provided with a pair of crushing rollers wherein a scraping plate is urged to a cylindrical surface of each crushing roller for the entire length thereof and a main motor is provided for driving said carding machine together with said crushing rollers; comprising, a pair of horizontal pins mounted on a frame of said carding machine for turnably supporting each scraping roller thereabout, means for urging each of said scraping plates to the cylindrical surface of the corresponding crushing roller, means for simultaneously positioning said scraping plates in contact with said crushing rollers or in a position spaced from said crushing rollers alternatively, a manually operable handle for actuating said setting means, an electric switch to open a circuit between said main driving motor and an electric source when said operable handle is operated so that said setting means positions each scraping plate to said spaced position from the corresponding crushing roller, or to close the circuit when said operable handle is operated so that said setting means positions each scraping plate in contact with the corresponding crushing roller.

3. Safety device of a carding machine provided with a pair of crushing rollers according to claim 2, wherein said urging means comprises a first urging means of a first scraping plate related to a top one of said crushing rollers and a second urging means of a second scraping plate related to a bottom one of said crushing rollers, said first urging means comprises a pair of first spring plates secured to said first scraping plate at an end portion thereof turnably mounted on said horizontal pins respectively, each of said first spring plates is provided with a first guide space formed at a bottom end portion thereof, said second urging means comprises a pair of second spring plates secured to said second scraping plate at an end portion thereof turnably mounted on said horizontal pins respectively, each of said second spring plates is provided with a second guide space formed at a bottom end portion thereof, a pair of connecting arms turnably mounted on said machine frame, each of said connecting arms is provided with a pin secured to a top end portion thereof, said pins of the connecting arms slidably pass through said first guide spaces of said first spring plates respectively, each of said connecting arms is provided with a pivot pin secured to a bottom end portion thereof, said pivot pins of the connecting arms slidably pass through said second guide spaces of said second spring plates, respectively, and are turnably connected to a part of said setting means.

4. Safety device of a carding machine provided with a pair of crushing rollers according to claim 3, wherein said setting means comprises a cross-shaft turnably mounted on said machine frame at a position below said crushing rollers in parallel condition to a nip line of said crushing rollers, a pair of eccentric cams rigidly mounted on said cross-shaft at each position outside of said machine frame, a horizontal pin shaft secured to said machine frame in parallel condition to said cross-shaft, a pair of swing levers turnably mounted on said horizontal pin shaft at both positions outside said machine frame each of said swing lever provided with a rectangular cut-out space wherein one of said eccentric cams of the same outside slidably engaged; a stop lever secured to an end portion of one of said eccentric cams, said stop lever provided with an adjusting screw adjustably mounted on an end portion thereof at a position where said adjusting screw is capable of contacting an end portion of said horizontal pin shaft, each of said swing levers provided with a pivotal connected portion capable of being turnably connected to respective pivot pins of said connecting levers of said urging means.

5. Safety device of a carding machine provided with a pair of crushing rollers according to claim 4, wherein said manually operable handle is a handle rigidly mounted to an outside end portion of said cross-shaft.

6. Safety device of a carding machine provided with a pair of crushing rollers according to claim 5, wherein said circuit comprises an electric connection between said main driving motor and an electric source, and a series of two switches inserted into said electric connection, one of said switches being a main switch to operate said carding machine and the other switch being a control switch for opening said electric circuit when said first and second scraping plates are spaced from said corresponding crushing rollers and for closing said electric circuit when said first and second scraping plates are in contact with said corresponding crushing rollers; a limit switch mounted on said machine frame to actuate said control switch and having a feeler, and an actuator rigidly mounted on said stop lever to push said feeler to actuate said limit switch to in turn actuate said control switch.

* * * * *

UNITED STATES PATENT OFFICE

CERTIFICATE OF CORRECTION

Patent No. 3,975,798 Dated August 24, 1976

Inventor(s) Takashi Katoh, et al

It is certified that error appears in the above-identified patent and that said Letters Patent are hereby corrected as shown below:

Column 5, line 64: "and" should be --or--.

Signed and Sealed this

First Day of February 1977

[SEAL]

*Attest:*

RUTH C. MASON
*Attesting Officer*

C. MARSHALL DANN
*Commissioner of Patents and Trademarks*